US005672182A

United States Patent [19]

Smith

[11] Patent Number: 5,672,182

[45] Date of Patent: Sep. 30, 1997

[54] DEVELOPER SYSTEM FOR BASE REACTABLE PETROLEUM FUEL MARKERS

[75] Inventor: Michael J. Smith, Newtown, Pa.

[73] Assignee: United Color Manufacturing Inc., Newtown, Pa.

[21] Appl. No.: 686,408

[22] Filed: Jul. 26, 1996

Related U.S. Application Data

[63] Continuation of Ser. No. 421,325, Apr. 13, 1995, abandoned.

[51] Int. Cl.[6] ..... C10L 1/22; C10L 1/18

[52] U.S. Cl. ..... 44/349; 44/350; 44/351; 44/422

[58] Field of Search ..... 44/349, 350, 351, 44/422

[56] References Cited

U.S. PATENT DOCUMENTS

| | | | |
|---|---|---|---|
| 1,997,670 | 4/1935 | Armour | 44/9 |
| 2,046,365 | 7/1936 | Cassidy et al. | 436/141 |
| 2,063,575 | 12/1936 | Adams | 87/9 |
| 2,522,939 | 9/1950 | Gamrath | 260/337 |
| 2,522,940 | 9/1950 | Gamrath | 260/337 |
| 3,468,640 | 9/1969 | Barusch et al. | 44/422 |
| 3,488,727 | 1/1970 | Diassi et al. | 44/350 |
| 3,883,568 | 5/1975 | Turner et al. | 260/383 |
| 4,209,302 | 6/1980 | Orelup | 44/334 |
| 4,514,503 | 4/1985 | Orelup | 436/60 |
| 4,735,631 | 4/1988 | Orelup | 44/59 |
| 4,764,290 | 8/1988 | Currey | 252/11 |
| 4,764,474 | 8/1988 | Orelup | 436/111 |
| 4,787,916 | 11/1988 | Feldman | 44/422 |
| 4,904,765 | 2/1990 | Derber et al. | 534/573 |
| 4,918,020 | 4/1990 | Nowak | 44/334 |
| 5,066,580 | 11/1991 | Lee | 435/721 |
| 5,145,573 | 9/1992 | Riedel et al. | 208/14 |
| 5,156,653 | 10/1992 | Friswell et al. | 44/328 |
| 5,205,840 | 4/1993 | Friswell et al. | 44/428 |
| 5,250,081 | 10/1993 | Habeeb et al. | 44/422 |
| 5,252,106 | 10/1993 | Hallisy | 44/328 |
| 5,304,493 | 4/1994 | Nowak | 44/312 |
| 5,487,770 | 1/1996 | Dyllick-Brenzinger et al. | 44/328 |
| 5,498,808 | 3/1996 | Smith | 585/3 |

FOREIGN PATENT DOCUMENTS

| | | |
|---|---|---|
| 2141667 | 1/1973 | France . |
| 16 43 464.3 | 5/1971 | Germany . |
| 43 08 634 A1 | 9/1994 | Germany . |
| 357179 | 9/1931 | United Kingdom . |
| 361310 | 11/1931 | United Kingdom . |
| 0 543 057 A1 | 5/1993 | WIPO . |

OTHER PUBLICATIONS

Chemical Abstracts, vol. 123, Abstract No. 85944, Dyllick-Brenzinger et al, "Dectection of Marked Hydrocarbon Oils and Azo Dyes Therefor" (Apr. 1995).

*Primary Examiner*—Ellen M. McAvoy
*Attorney, Agent, or Firm*—Howrey & Simon

[57] ABSTRACT

Colorless markers for petroleum products and methods of detecting them.

29 Claims, No Drawings

DEVELOPER SYSTEM FOR BASE REACTABLE PETROLEUM FUEL MARKERS

CROSS REFERENCE TO RELATED APPLICATION

This application is a continuation of U.S. patent application Ser. No. 08/421,325 (filed Apr. 13, 1995), now abandoned.

BACKGROUND OF THE INVENTION

The present invention relates to reagents useful in developing color or fluorescence of base-reactable markers. It also relates to a method for bleaching the color of the developed marker to restore the fuel to its original appearance so that it may be combined with undeveloped marked fuel, avoiding the necessity of disposing separately of a potentially hazardous marker extract.

For some time it has been customary to mark or tag petroleum products, particularly fuels, heating oil and related products, with colorless or weakly colored chemical compounds whose presence in the fuel is not visually obvious. To render such colorless markers visible, the tagged fuel is contacted with an aqueous or alcoholic solution of a strong base, for instance, alkali metal hydroxides or aliphatic amines. These form a colored anion which separates from the relatively non-polar fuel into the immiscible polar aqueous or alcoholic phase where it may be observed or assayed. This separated phase is classifiable as a hazardous waste and presents problems of safe and lawful disposal, especially when examinations are made "in the field." Furthermore, the fuel with which it was in contact may be water wet, making return to its original source undesirable and thus presenting an additional waste disposal problem.

By using a developing agent of the present invention, especially an alcoholic solution of a tetra alkyl ammonium hydroxide, the indicative color or fluorescence of the marker can be made plainly visible and can be quantified without extraction from the petroleum product. Furthermore, at the end of the test the effect of the developing agent may be reversed by the addition of a small amount of a fuel-compatible acid, especially a carboxylic acid. The fuel may be returned to its original source thereby minimizing or eliminating hazardous waste disposal problems. The small amounts of developing agent, particularly quaternary ammonium base, or its salt, with the carboxylic acid, do not appear to have any adverse effect on the combustion properties of the fuel and are consumed therewith without appearing to contribute to any fuel combustion emmissions problems.

As previously noted, a marker is a substance which can be used to tag petroleum products for subsequent detection. The marker is dissolved in a liquid to be identified, then subsequently detected by performing a simple physical or chemical test on the tagged liquid. Markers are sometimes used by government to ensure that the appropriate tax has been paid on particular grades of fuel. Oil companies also mark their products to help identify those who have diluted or altered their products. These companies often go to great expense to make sure their branded petroleum products meet certain specifications, for example, volatility and octane number, as well as to provide their petroleum products with effective additive packages containing detergents and other components. Consumers rely upon the product names and quality designations to assure that the product being purchased is the quality desired.

It is also possible for unscrupulous gasoline dealers to increase profits by selling an inferior product at the price consumers are willing to pay for a high quality branded or designated product. Higher profits can also be made simply by diluting the branded product with an inferior product. Policing dealers who substitute one product for another or blend branded products with inferior products is difficult in the case of gasoline because the blended products will qualitatively display the presence of each component in the branded products. The key additives made to the branded products are generally present in such low levels that quantitative analysis to detect dilution with an inferior product is very difficult, time consuming and expensive.

Marker systems for fuels and other petroleum products have been suggested but various drawbacks have existed which have hindered their effectiveness. Many, for instance, lose their effectiveness over time, making them too difficult to detect after prolonged storage. In addition, reagents used to develop the color of markers often are difficult to handle or present disposal problems. Furthermore, some marking agents partition too readily into water. This causes the markers to lose effectiveness when storage occurs in tanks that contain some water and results in deposits of the marker that are difficult to dispose of.

The present invention provides developing agents for use with a wide range of markers that react with base. The markers are essentially invisible in liquid petroleum products at an effective level of use but provide a distinctive color and/or fluorescence when contacted by an appropriate developing agent of the present invention. The procedure for developing color or fluorescence is simple to perform in the field and the reagents used to develop the color are easy to handle and dispose of.

SUMMARY OF INVENTION

The present invention includes compositions for and methods of detecting or developing base reactable fuel markers. Developing agents of its present invention contain quaternary or tetra alkyl ammonium hydroxides or alkoxides of the following formula:

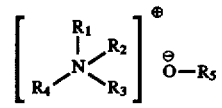

Where $R_1$, $R_2$, $R_3$ and $R_4$ are the same or different alkyl or benzyl groups and $R_5$ is hydrogen or an alkyl group.

DETAILED DESCRIPTION OF THE INVENTION

The quaternary alkyl ammonium hydroxides or alkoxides of the present invention are readily available commercially from chemical supply companies such as RSA Corporation. The techniques for making them on a commercial scale are therefore known. They are almost always produced and used in solution because they are usually difficult to manufacture and use in solid form. Although most of them are available as aqueous solutions, and can be used as such in the present invention, it is much more convenient and preferable to use them as solutions in a non-aqueous solvent that is miscible with hydrocarbon fuels. Suitable solvents include aliphatic or aromatic alcohols, glycols and glycol ethers. The lower alcohols, such as methanol, ethanol and propanol are convenient for this purpose, particularly when the petroleum product is gasoline. For use with other petroleum products, for instance use in conjunction with marked diesel fuels, a less volatile solvent is preferred. Generally, the alkyl glycol monoethers are particularly valuable in this respect and especially ethylene glycol mono n-propyl ether which presents a desirable combination of properties including good solvency power and miscibility with petroleum fuels, less vapor pressure at ambient temperatures, which minimizes human exposure and fire hazards, and relatively low acute toxicity.

The concentration of the tetra alkyl ammonium bases in solutions of the present invention may be varied over a wide range. It is preferred that enough base is present to react with all the marker in the fuel sample. For practical reasons a solution of about 1–10%, preferably about 5–10%, of quaternary ammonium base in alcohol is considered desirable for commercial purposes. An alcohol solvent will therefore ordinarily make up about 90–99% of the non-aqueous solution.

Markers which may be used with the present developing agents include hydroxyphthaleins and derivatives of furanone, as described below. In addition, markers previously described in U.S. Pat. Nos. 5,156,653; 5,205,840; 4,764,474; and 4,735,631, the disclosures of each of which are incorporated herein by reference, can be used with the developing agents of the present invention.

Developing reagents of the present invention may be used, for instance, with marker compositions comprising a liquid petroleum product and a detectable level of marker which is a derivative of 2(3H) Furanone in which the number 5 carbon atom is part of a xanthene system:

I

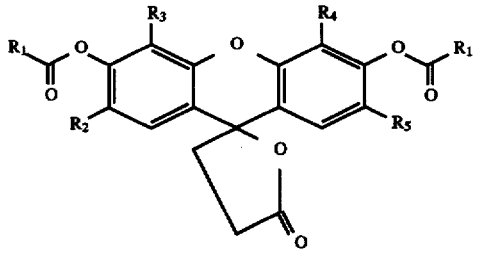

wherein $R_1$ is an alkyl group containing from one to eighteen carbon atoms, or an aryl group. $R_2$, $R_3$, $R_4$, and $R_5$ are hydrogen, chlorine, bromine or a $C_1$–$C_{12}$ alkyl. $R_1$ may be the same or different groups and $R_2$–$R_5$ may be the same or different groups. The alkyl groups may be straight chain or branched chain. The carbon atoms 1 and 2 of the (3H) Furanone ring may be saturated or an ethylenic bond may exist between them. The hydrogen atoms attached to these carbon atoms may also be replaced wholly or in part by alkyl groups.

Other markers useful with developing agents of the present invention are organic esters of fluorescent dyestuffs of the hydroxyphthalein subclass of Xanthene dyes, as classified in the "Colour Index", third edition, 1975. These are more commonly referred to as organic esters of fluorescein ($C_{20}H_{12}O_5$). Especially preferred are the esters of 3'6' dihydroxy Spiro[isobenzofuran-1(3H),9'-(9H)xanthene]-3-one, commonly called Fluorescein, which is symbolized as:

II

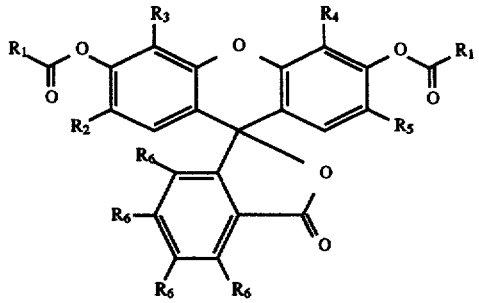

where $R_1$ is an alkyl of 1–18 carbon atoms or an aryl group. Also preferred are esters of Fluorescein where the aromatic ring hydrogen atoms 1',2',4',5',7' and 8' and 4,5,6,7 are replaced by non-ionizing substituents such as alkyl groups, hydrogen, chlorine or bromine. In particular, the invention includes the above compounds when $R_2$, $R_3$, $R_4$, and $R_5$ are hydrogen, chlorine, or bromine or $C_1$–$C_{12}$ alkyl and $R_6$ is hydrogen, chlorine or bromine. $R_1$–$R_6$ may be the same or different groups and alkyl groups may be straight or branched. For many applications $R_2$–$R_6$ are preferably H and $R_1$ is preferably a $C_1$–$C_4$ alkyl group.

Fluorescein itself has been used in the form of its water soluble salts as a marking or tagging substance for both artificial and natural water courses, for examples, so that the course of streams, rivers and sewer lines can be traced. It has also been used as a diagnostic marker in the human vascular system. It is usually considered a tinctorially weak yellow dye and is most valued for its ease of detection, even at very considerable dilution exhibiting strong fluorescence. This fluorescence is observable under natural or appropriate artificial light sources, especially a long-wave ultraviolet, or "black light" lamp. A spectro-fluorimeter can accurately quantify Fluorescein concentrations down to one part per billion ($10^{-9}$ grams per milliliter). Fluorescein is also known for its low toxicity and ready biodegradability.

Fluorescein is not itself suitable as a marker for petroleum fuels, however, because it partitions readily between water and petroleum. When fuel containing Fluorescein is in contact with water, as often happens in fuel storage tanks, the compound partitions between the two phases and is rendered useless as a quantitative petroleum marker.

By converting Fluorescein to an organic diester any tendency to water bleed (partition) can be minimized or eliminated, by use of an esterifying agent. The diester may be derived from an organic acid, its anhydride or halide containing from one to eighteen carbon atoms. Another advantage of esterification is that the weak yellow color of Fluorescein itself is diminished to a negligible extent in technical quality products, and can be eliminated entirely in purified material. This renders the presence of the marker substance in the marked fuel invisible to the human eye. The esterification therefore prevents the marker from obscuring coloring agents that may have been added to comply with regulatory requirements or for other reasons.

The marker compounds of Formulas I and II may be synthesized by any of a number of conventional methods for estrifying phenolic hydroxy groups. These include direct esterification with acids, reaction with acid halides, especially acid chlorides, and most significantly by reaction with acid anhydrides. In general, the preferred technique is to react the hydroxy xanthene with the acylating agent under aqueous or non aqueous conditions as appropriate to the individual reactants. The esters obtained from the lower aliphatic carboxylic acids are relatively high-melting solids and may be isolated as such. Esters of the higher carboxylic acids tend to be low-melting solids or viscous liquids which may be isolated as solutions in an appropriate solvent.

The formula of preferred markers resulting from the esterification reaction is set forth below:

II.

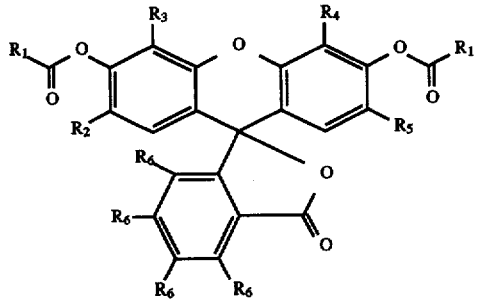

$R_1$ is a $C_1$–$C_{18}$ alkyl group or an aryl group. Preferably, $R_1$ is $C_1$–$C_4$ in either the normal, or branched chain forms. In many petroleum product applications, $R_2$–$R_6$ are preferably all hydrogen. The presence of halogen atoms in the carbocyclic ring systems may provide different shades of visible color and fluorescence after hydrolysis of the ester. Bromine atoms, for instance, tend to impart a redder shade to the product compared with hydrogen atoms.

Esters useful as markers may be produced and used in dry form (usually power, crystals or flakes) or liquid form. Liquid forms are usually preferred for handling reasons. Esters of the present invention may be produced directly and used directly as liquids without addition of solvents. Often, however, it is preferred to combine the marker with a solvent for the marker and which is also itself readily soluble in the petroleum product to be marked. Accordingly, prior to mixing with many petroleum products, the marker may be dissolved, by conventional techniques, in a solvent that has complete compatability with the petroleum products being marked. Suitable solvents for use with liquid petroleum products, for instance, include aromatic hydrocarbons (especially alkyl benzenes, such as xylene, and naphthalenes), aromatic alcohols, especially Benzyl alcohol, and aprotic solvents like formamide, N,N dimethylformamide, N,N dimethyl acetamide or 1 methylpyrrolidone. These solvents may be used singly or advantageously in blends. The aprotic solvents are particularly useful as a cosolvent combined with an aromatic or aromatic alcohol solvent. For instance, a composition comprised of about 0.5–10% by weight marker, about 70–80% by weight aromatic hydrocarbon solvent and about 10–30% by weight aprotic solvent may be particularly useful as a composition that dissolves readily in many liquid petroleum products and is stable in the product; that is, it remains dissolved in the petroleum product for a commercially significant period of time.

Particularly when combined with appropriate solvents, the foregoing esters form stable liquid compositions that dissolve readily into petroleum products. The availability of marker compounds as stable, free-flowing liquids makes them much more attractive to the petroleum industry than dry or solid products primarily because liquids are easier to handle. Dry or solid forms of markers, however, could be used.

Additional markers useful in conjunction with the developing reagents of the present invention are represented by the following structures:

III.

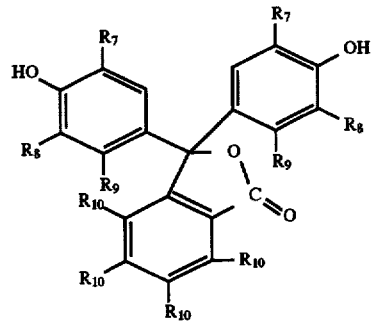

Wherein $R_7$ is an alkyl or alkoxy group containing 1 to 8 carbon atoms; $R_2$ and $R_3$ are hydrogen, alkyl or alkoxy groups. $R_{10}$ is any combination of bromine, chlorine, or hydrogen. Preferably, the total number of alkyl carbon atoms in $R_7$, $R_8$ and $R_9$ combined does not exceed 12. These are known as derivatives of 1(3H) iso benzofuranone.

Alternatively, carbon atoms $R_8$ and $R_9$ may form part of a naphthalene ring system as illustrated below:

IV.

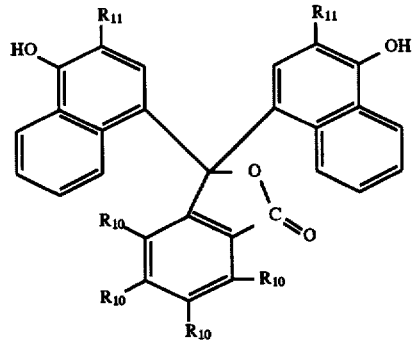

Wherein $R_{11}$ is a hydrogen atom, alkyl or alkoxy group containing 1–8 carbon atoms and $R_{10}$ is the same as described above.

The foregoing marker compounds of Formulas III and IV may be synthesized by any of a number of conventional methods involving, for instance, the condensation of one molar equivalent of a 1,2 Phthalic acid, or preferably its anhydride, with two molar equivalents of a 2 alkylphenol or a 1 naphthol, where the carbon atom at the 4 position with respect to the aromatic hydroxy group in the 1 position is available for reaction. The actual condensation reaction is brought about by the action of heat, preferably in the presence of a dehydrating acid like orthophosphoric acid, sulfuric acid or methane sulfonic acid or by a metal halide of the type reactive in Friedel-Crafts synthesis especially aluminum chloride, stannic chloride or zinc chloride. The last named catalyst is particularly effective when employed in the synthetic techniques recommended by Gamrath in U.S. Pat. Nos. 2,522,939 and 2,522,940 for the synthesis of Phenolphthalein, the disclosures of which are incorporated by reference herein in their entirety. A combination of dehydrating acid and Friedel-Crafts metal halide is also satisfactory. The procedures outlined in the Gamrath patents are useful generally for making compounds of Formulas III and IV.

The marker compounds of formulas III–IV may be used in dry form as a powder or crystals or as a liquid solution concentrate. Liquid forms are usually preferred for handling reasons. To provide a liquid concentrate solution containing marker, the marker is dissolved or diluted into a solvent that has a high solubility in the petroleum products. Suitable solvents for use with liquid petroleum products include, for instance, aromatic hydrocarbons, especially alkyl benzenes, such as xylene, and naphthalenes; aromatic alcohols, especially Benzyl alcohol and Phenolglycolether; and aprotic solvents like formamide, N,N dimethylformamide, N,N dimethyl acetamide or 1 Methyl pyrrolidone. These solvents may be used singly, or advantageously, in blends. When combined with appropriate solvents, markers, of the present invention, form stable liquid compositions that dissolve readily into petroleum products. The availability of marker compounds as stable, free-flowing liquids makes them much more attractive to the petroleum industry than dry or solid products primarily because liquids are easier to handle. Dry or solid forms of markers can, however, be used directly.

One specific form of marker that may be used herein is Thymolphthalein. Its structure is represented by the following formula:

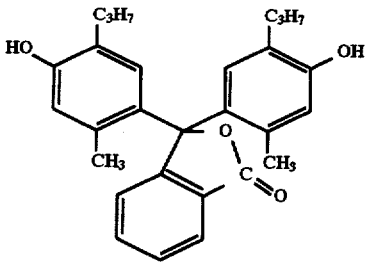

V.

It may be formed by condensation of one molar equivalent of phthalic acid or anhydride with two molar equivalents of 2 isopropyl 5 methyl phenol (Thymol), in the presence of dehydrating agent such as phosphoric acid, stannic chloride or zinc chloride. The compound is prepared in good yields by the procedures recommended for Phenolpththalein as disclosed in U.S. Pat. No. 2,522,939.

Thymolphthalein may be used in dry form (usually powder or crystals) or as a liquid solution concentrate. Liquid concentrates may be prepared by combining the marker with a solvent for the marker which solvent is also itself completely miscible with the petroleum product to be marked. Because the direct solubility of Thymolphthalein in straight petroleum hydrocarbons is somewhat limited, it is especially advantageous to include in the solvent composition an aprotic solvent, particularly 1 Methyl 2 Pyrrolidone which greatly increases the solubility of the Thymolphthalein in the hydrocarbon. Other useful solvents include suitable aromatic hydrocarbons, especially alkyl benzenes, such as xylene, and naphthalenes; aromatic alcohols, particularly Benzyl alcohol and Phenolglycolether; and other aprotic solvents, particularly formamide, N,N dimethylformamide and NN dimethylacetamide.

A liquid concentrate solution of any of the foregoing markers will generally be comprised of about 5%–50% by weight marker and about 50%–95% by weight solvent. Preferable ranges for the solution may be 15%–25% by weight marker and about 75%– 85% by weight solvent. Suitable solvents include both aprotic and aromatic solvents. The amount of aprotic solvent included in the solution depends upon the amount of marker added, the viscosity of the solution, the relative cost of the aprotic solvent used, as well as other factors known in the art. The aromatic solvent or cosolvents used in a particular liquid concentrate solution will be selected based upon the type of petroleum product that is to be marked. For instance, a more volatile solvent will be chosen to mark gasoline products and a less volatile solvent will be used in liquid concentrate solutions to mark diesel fuel or home heating oil products.

Particularly when combined with appropriate solvents, Thymolphthalein and other compounds of the present invention form stable liquid compositions that dissolve readily into petroleum products. The availability of the marker compound as a stable, free-flowing liquid makes it much more attractive to the petroleum industry than dry or solid products primarily because liquids are easier to handle. Dry or solid forms of markers, however, could be used.

The base-reactable markers of the present invention may be added to any liquid petroleum products such as fuels, lube oils and greases. Examples of liquid petroleum products that may be marked and identified in accordance with the present invention are gasoline, diesel fuel, fuel oil, kerosene and lamp oil. The ester markers, when developed, are detectable visually over a wide range of concentrations but preferably are present at a level of at least about 0.5 ppm to 5 ppm and most preferably at a level of about 0.5 to about 100 ppm. Other markers described and incorporated herein are useful when present in these same ranges of concentration.

Because most of the preferred markers are essentially colorless in petroleum products, their presence is detected by reacting them with a developer or developing reagent of the present invention. Developing reagent of the present invention must contain a quaternary ammonium hydroxide or an alkoxide represented by the following formula:

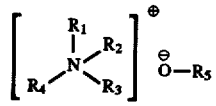

Where $R_1$, $R_2$, $R_3$ or $R_4$ are the same or different alkyl groups, preferably from 1 to about 12 carbon atoms, especially methyl, ethyl, propyl, butyl or benzyl groups, or any combination thereof and $R_5$ is hydrogen or an alkyl group. When $R_5$ is an alkyl group it preferably has from 1 to about 8 carbon atoms. Quaternary ammonium hydroxides are generally preferred for commercial use.

Preferred components of the developing agent are tetramethylammonium hydroxide, tetraethylammonium hydroxide, tetrapropylammonium hydroxide, tetra n-butyl ammonium hydroxide, Benzyltrimethylammonium hydroxide and Benzyltrimethylammonium methoxide. All of the foregoing are commercially available by their chemical name.

In use, a sample of petroleum product containing a base reactable marker is obtained and is brought into contact with a developing agent of the present invention. Adding a developing agent to the sample and adding the sample to the developing agent are equivalent techniques. The pH of the developing reagent is about 10 to about 14 and preferably about 11 to about 13. Once in contact with the suggested bases the markers promptly form a highly colored or fluorescent chemical believed to be a dianion. The intensity of the dianion permits easy visual detection. Providing that only a qualitative indication of the presence of the marker is required, the now-colored, "developed", fuel may be returned to its source. In this way, the developing reagent and marker are burned or used up with the product so that no potentially hazardous waste from, say, a roadside test, accumulates for disposal.

The markers described and incorporated herein can be mixed together and need not be used separately. Of particular interest are combinations of markers of Formulas I and II, which develop fluorescence, with markers of Formulas III and IV. These combinations can provide compositions which, when developed with a developing agent, are dichroic. One example of this is a combination of Thymolphthalein (Formula V), which develops into a blue color if used alone, and Formula II wherein $R_1$ is $C_3H_7$ and $R_{2-6}$ are H, which develops yellow color with green fluorescence when used alone. When used in combination and developed with a strong base, preferably a developing agent of the present invention, a blue/green dichroic effect is observed. The developed sample is simultaneously made blue by transmitted Light and green by reflected light.

Prior to returning the marker developed fuel sample to its original source, the color of the developed market may be destroyed by the addition of a fuel miscible acid, preferably an organic carboxylic acid such as oleic acid, isostearic acid or 2-ethylhexoic acid. In this way fuel at the original source will not be color contaminated by the addition of "developed" fuel which may contain unreacted active developer.

In the event that the color of the developed marker is obscured by other coloring agents in the petroleum product, the marker may be rendered more visible by extraction from the developed fuel into an extraction medium. This may be accomplished by addition of water alone as an extraction medium to the sample, but use of mixtures of water and a phase separation enhancer such as aliphatic alcohols, glycols, or glycol ethers are preferred. Use of a phase separation enhancer promotes an easier separation of the aqueous and organic phases. Additionally, other substances, for example pH buffer salts, may be present in the extractant phase to stabilize the colored sample. Preferred extraction medium mixtures may also contain quaternary ammonium hydroxide compounds to provide a simple method of developing color by forming the dianion and a suitable medium into which the developed dianion can be immediately extracted. Other strong bases, of course, may be used, particularly alkalai metal hydroxides.

The extracted phase may be examined visually for a qualitative determination of the markers presence. At extremely low concentrations (about 1 to about 500 parts per billion) the fluorescent markers may be rendered more readily visible by irradiation of the extracted marker with long-wave ultraviolet light. Alternatively, the extracted marker may be detected and quantified by visible light absorption spectrophotometry or, in the case of fluorescent markers, by spectrofluorimetry. An advantage of the extraction technique is that it affords the opportunity to concentrate the marker from the petroleum fuel, thereby increasing the sensitivity of the test procedures.

The following Examples 1–42 illustrate markers useful in connection with developing agents of the present invention and their use with such developing agents. Examples 43–52 further illustrate developing agents of the present invention and their use.

EXAMPLE 1

33.2 grams of Fluorescein is added to a stirred 500 ml reaction flask already containing 200 grams of glacial acetic acid and 25 grams of acetic anhydride. 0.3 grams of concentrated sulfuric acid is then added and the flask is stoppered. The contents of the flask are then heated externally until they start to boil. Boiling is continued under reflux until a sample of the flask contents examined by thin layer chromatography indicates that all of the original Fluorescein is converted to its diacetate ester.

The contents of the flask are then cooled below the boiling point and added slowly, with good stirring, to 600 mls of cold water. The mixture is stirred to hydrolyze unreacted acetic anhydride, after which the product is recovered by filtration on a Buchner funnel, it is washed free from acetic acid with distilled water, then dried to constant weight at 105° C. The product is obtained as creamy white crystals in almost quantitative yield. The compound has a melting point of 199°–203° C.

EXAMPLE 2

The above procedure is repeated with 50 grams of 2,7 di-n-hexyl Fluorescein replacing the 33.2 grams of fluorescein. The final product, 2,7 di-n-hexyl 3.6 diacetoxyfluorescein, is obtained as a yellowish cream solid.

EXAMPLE 3

The procedure from Example 1 is again repeated with 65 grams of 2,4,5,7 tetrabromofluorescein replacing the 33.2 grams of fluorescein. The product, 2,4,5,7 tetrabromo 3,6 diacetoxyfluorescein, is obtained as a pale yellow powder.

EXAMPLE 4

The procedure from Example 1 is repeated with 79.0 grams of 4,5,6,7 tetrachloro 2,4,5,7 tetrabromofluorescein replacing the 33.2 grams Fluorescein. The final product, the diacetylester of the starting material, is a pale yellow powder.

EXAMPLE 5

The procedure from Example 1 is repeated except that the 25 grams of acetic anhydride is replaced by 40 grams of butyric anhydride. The esterification procedure is somewhat slower but ultimately an almost quantitative yield of the di-n-butoxy ester of Fluorescein is obtained.

EXAMPLE 6

33.2 grams of fluorescein, contained in a 500 ml reaction flask, is dissolved in 600 milliliters of cold water by the addition of 16 grams of a 50% solution of sodium hydroxide. 12 grams of anhydrous sodium carbonate is now added to the contents of the flask, followed by 160 mls of xylene solvent. The two-phase system is then stirred at 20°–25° during the 60 minute dropwise addition of 40 grams of butyric anhydride. As the esterification of the fluorescein proceeds, the intense color and fluorescence of the lower aqueous phase is discharged, and the product dissolves in the xylene to form a pale yellow non-fluorescent solution. When all the butyric anhydride has been added, the reaction mixture is heated externally to 50°–55° C. until thin layer chromatography indicates the esterification is complete. The two phases are allowed to separate and the lower aqueous phase, containing a mere trace of unreacted fluorescein, is removed. To the remaining upper xylene phase is added 50 grams of 1-methylpyrollidone. The contents of the flask are then placed under vacuum and all traces of water, and sufficient xylene, are azeotropically distilled out until the total weight of the reaction mass is 165 grams. This almost colorless solution of the dibutyl ester of fluorescein is filtered and placed in storage. The solution has good resistance to crystallization even when stored for 3 months at 0° Fahrenheit.

EXAMPLE 7

The procedure of Example 6 is repeated except that the n-butyric anhydride is replaced by an equal weight of iso-butyric anhydride. A similar product is obtained except that it has even better resistance to crystallization when stored for prolonged periods at low temperatures.

EXAMPLE 8

The procedure of Example 6 is repeated except that 40 gms of butyric anhydride is replaced by 47 gms of pivalic anhydride. The final di(1,1,1 trimethylacetyl) ester of the fluorescein is an off-white solid with essentially the same marker properties as the di-n-butyl ester of Example 6.

EXAMPLE 9

The procedure of Example 6 is repeated except that the 33.2 grams of fluorescein is replaced by 50.8 grams of 4,5,6,7 tetrachlorofluorescein. The final product forms a pale yellow solution which is less stable to extended refrigerated storage than the product of Example 6.

EXAMPLE 10

20 grams of Fluorescein diacetate prepared as in example one is stirred into 50 grams of Exxon Aromatic® 200 solvent and 30 grams of 1 Methylpyrollidone is added. The mixture is heated to 80° F. until all of the ester has dissolved, the hot solution is filtered and bottled. The solution shows only a slight tendency to crystallize upon prolonged storage at 0° F.

EXAMPLE 11

50 grams of Fluorescein dibutyrate prepared by the method of Example 4 is dissolved in 50 grams of 1 Methylpyrollidone by gentle heating. The filtered solution has excellent storage stability at 0° F.

EXAMPLE 12

33.2 grams of Fluorescein is added to 150 mls of pyridine to which 36 grams of 2 ethyl hexanoyl chloride is added. The mixture is heated to reflux (125°) and boiled overnight. The reaction mixture was sampled the next morning and analyzed by thin layer chromatography which indicated that formation of the diester was complete. The reaction mixture was then poured into 1 liter of cold water which was then adjusted to pH 3 with hydrochloric acid. The product separated as a brownish oil which was extracted with toluene. The toluene solution was then vacuum stripped to remove all readily volatile material which left 65 grams of a brownish oil readily soluble in xylene to form a light brown solution.

EXAMPLE 13

11 grams of the 2(3H) furanone derivative known as Succinfluorescein prepared by the condensation of one molar equivalent of succinic anhydride with two of resorcinol under dehydrating conditions is mixed with 75 grams of pyridine. To this mixture is added 25 grams of Lauroyl chloride. The mixture is brought to reflux (125°) and boiled overnight until a sample of the reaction mixture analyzed by thin layer chromatography indicates complete esterification of the succinfluorescein. The reaction mixture is cooled to 90° and poured into 1 liter of cold water. The mixture is then acidified to pH 3 with hydrochloric acid. The product which is a brownish oil is extracted with 150 mls toluene. The resulting solution is dried free from extrained water by azeotropic distillation after which the remaining toluene is removed by vacuum distillation. The final product is a dark oil readily soluble in xylene to produce a light brown solution.

EXAMPLE 14

The procedure of Example 13 is followed except that the 25 grams of Lauroyl chloride is replaced by 35 grams of Stearoyl chloride. The final product is a light brown waxy solid readily soluble in xylene.

EXAMPLE 15

500 milligrams of the solution obtained in Example 7 is dissolved in toluene and made to 100 mls in a graduated flask. 1.0 ml of this solution is pipetted into 100 mls of premium gasoline (purchased retail), already colored red with 3 parts per million of Unisol Liquid Red B, and contained in a separatory funnel. The gasoline sample contains the equivalent of 10 ppm Fluorescein diacetate as a marker. 5 mls of an aqueous solution containing 15% sodium chloride and sufficient potassium hydroxide to raise its pH to 12.0 is now added to the marked gasoline in the separatory funnel. The two phases are shaken together for two to three minutes, then allowed to separate. The upper gasoline phase retains its light red appearance but the lower aqueous phase now has a strong green fluorescence. This phase may be separated and the quantity of highly fluorescent dye measured by spectrophotometry or spectrofluorimetry. The separated solution may require a fivefold or greater dilution with more extractant to bring its absorbence/emission characteristics into the optimum sensitivity range of the measuring instruments.

EXAMPLE 16

Five milliliters of marked colored gasoline prepared as in Example 10 are mixed with 95 milliliters of unmarked gasoline. This mixture is again subjected to the same extraction procedure with alkaline salt water as in Example 15. Even with this much-diminished concentration of marker the aqueous extract is noticeably fluorescent and again the quantity of dye may be measured instrumentally, if desired, by comparison with a calibration standard.

EXAMPLE 17

A 50 milliliter sample of gasoline marked with 10 parts per million of dibutyrate ester of Fluorescein prepared in accordance with Example 6 has added to it 5 milliliters of a developer composition, which is a 10% solution of tetrabutyl ammonium hydroxide dissolved in diethylene glycol. The mixture is shaken for 1 to 2 minutes, when it acquires a dark fluorescent green appearance, clearly visible above the red background color of the gasoline. If only a qualitative detection of the marker in the gasoline is required, the developed, marked gasoline may be returned to the fuel source; thus avoiding a separate potentially hazardous waste disposal problem. If a quantitative determination of the marker is needed or desired, this can be accomplished by direct spectrophotometry or spectrofluorimetry, depending on the level of background interference from other components in the fuel. Otherwise, a 5 milliliter aliquot of a 10% solution of sodium chloride in distilled water may be added to the developed, marked fuel. When the mixture is shaken together for a short time the fluorescent marker will extract into a lower aqueous phase which may be separated and quantified as in Example 15.

EXAMPLE 18

A gasoline solution of 15 parts per million of 2,4,5,7 tetrabromo 3,6 diacetoxy fluorescein, synthesized as in example three, is prepared. The mixture is then subjected to the same development and extraction procedure detailed in Example 15. This time the separated aqueous phase is a bright red color with an orange fluorescence. The quantity of the eosine dye generated may also be quantified by spectrophotometry or spectrofluorimetry.

EXAMPLE 19

The procedure of Example 13 is repeated with the diacetyl ester of 4,5,6,7 tetrachloro 2,4,5,7 tetrabromofluoresceine.

The hydrolized extracted marker contains the dianion of the dye historically known as Phloxine B. It has a bright cherry-red color with a dark green fluorescence.

EXAMPLE 20

100 milliliters of the gasoline solution containing 15 parts per million of the dibutyl ester of 4,5,6,7 tetrachloroFluoresceine, prepared as in Example 7, has added to it 5 milliliters of an 8% solution of tetramethyl ammonium hydroxide in ethylene glycol mono n-propyl ether. The mixture is shaken and develops a dark green fluorescent appearance. The addition of 5 milliliters of a 10% aqueous sodium chloride solution will extract the hydrolyzed marker into a lower aqueous phase where it forms a brownish orange solution with a dark green fluorescence, quite different in appearance from the fluorescence of the unchlorinated dye instanced in Example 17 and easily distinguished from it.

EXAMPLE 21

100 milliliters of an essentially colorless toluene solution containing 30 parts per million of the distearoyl ester of succinfluorescein prepared as in Example 14 is shaken for one minute with 20 mls of a mixture of 2 parts tetramethylammonium hydroxide, 48 parts ethylene glycol mono n-propyl ether and 50 parts water. The mixture is then allowed to separate. The lower aqueous phase has a very pale orange-yellow color which possesses a strong deep green fluorescence.

EXAMPLE 22

A stirred one liter glass flask is charged with 400 grams of anhydrous methane sulfonic acid. 200 grams of 2 isopropyl 5 methyl phenol (Thymol) is then added followed by 110 grams of phthalic anhydride. The reaction mixture is heated to 85° C. and maintained at this temperature for 5 hours. The flask contents are then drowned into 1,500 milliliters of well stirred cold water when the product precipitates as a red granular solid in the form of its oxonium salt. A sufficient amount of a 40% solution of sodium hydroxide is added to the stirred mixture to raise the pH to 4. This hydrolizes the oxonium salt and the product is converted to a light yellowish orange solid. The product is recovered by filtration, washed with cold water and then dried at 70° C. 256 grams of product is recovered with an active Thymophthalein content of 76.7%. This is 68.5% of the expected amount.

EXAMPLE 23

The above synthetic procedure is repeated except that 40 grams of anhydrous aluminum chloride is added after the phthalic anhydride. The reaction mixture is heated to 85°–90° C. and maintained for 4 hours during which time there is a copious evolution of hydrochloric acid gas. The reaction mixture is then drowned into cold water and neutralized to pH2 with sodium hydroxide. The precipitated product is recovered by filtration, water washed and dried. A yield of 235 grams of product, less colored than that obtained in example 1, is recovered. It contains 84.2% active Thymolphthalein, equivalent to about 74.9% of the theoretically expected amount.

EXAMPLE 24

A stirred one liter flask is charged with 500 grams of anhydrous methane sulfonic acid, 110 grams of Phthalic anhydride and 144 grams of ortho cresol. The mixture is warmed to 40° C. and 40 grams of anhydrous aluminum chloride added. The mixture is heated to 85° C. and maintained for 4 hours. It is then drowned into cold water which is then adjusted to pH2 with aqueous sodium hydroxide solution. The precipitated product is recovered by filtration, water washed and dried. 160 grams of a greyish-white solid is recovered which has an ortho cresolphthalein content of 98.2%. This is equivalent to 68.1% of the theoretically expected yield.

EXAMPLE 25

The procedure of Example 24 is repeated except the 144 grams of ortho cresol is replaced by 235 grams of 2 cyclohexyl phenol. The synthesis yielded 215.8 grams of creamy while solid with an assay of 79.5% which is 65% of the theoretically expected amount.

EXAMPLE 26

The procedure of Example 22 is repeated except that the 200 grams of 2 isopropyl 5 methylphenol is replaced by 195 grams of 1 Naphthol (98% pure). 255 grams of crude product is recovered.

EXAMPLE 27

20 grams of Thymolphthalein is stirred into 50 grams of Exxon Aromatic® 200 solvent and 30 grams of 1 Methylpyrrolidone is added. The mixture is heated to 40° C. until all of the ester has dissolved, the hot solution is filtered and bottled. The solution shows no tendency to crystallize upon prolonged storage at 0° F.

EXAMPLE 28

50 grams of Thymolphthalein is dissolved in 50 grams of 1 Methylpyrrolidone by gentle heating. The filtered solution has excellent storage stability at 0° F.

EXAMPLE 29

500 milligrams of the solution obtained in Example 1 is dissolved in toluene and made to 100 mls in a graduated flask. 1.0 ml of this solution is pipetted into 100 mls of premium gasoline (purchased retail), already colored red with 3 parts per million of Unisol Liquid Red B, and contained in a separatory funnel. The gasoline sample contains the equivalent of 10 ppm Thymolphthalein as a marker. 5 mls of an aqueous solution containing 15% sodium chloride and sufficient potassium hydroxide to raise its pH to 12.0 is now added to the marked gasoline in the separatory funnel. The two phases are shaken together for two to three minutes, then allowed to separate. The upper gasoline phase retains its light red appearance but the lower aqueous phase now has a strong blue color. This phase may be separated and the quantity of blue dye measured by spectrophotometry at its wavelength of maximum absorbance which occurs at approximately 590 nanometers.

EXAMPLE 30

The procedure of Example 29 is repeated with distilled, almost water white, gasoline except that 20 ppm of Thymolphthalein, as solution in toluene, is added. The presence of the marker causes no visible change in appearance of the gasoline.

EXAMPLE 31

Five milliliters of marked colored gasoline prepared as in Example 29 is mixed with 95 milliliters of unmarked gasoline. This mixture is again subjected to the same extraction procedure with alkaline salt water as in Example 29. Even with this much-diminished concentration of marker the aqueous extract is noticeably blue and again the quantity of dye may be measured instrumentally, if desired, by comparison with a calibration standard.

EXAMPLE 32

A 50 milliliter sample of red dyed gasoline marked with 10 parts per million of Thymolphthalein has added to it 5 milliliters of a developer composition, which is a 10% solution of tetrabutyl ammonium hydroxide dissolved in ethyleneglycol mono n-propyl ether. After the mixture is shaken for a few seconds it acquires a distinct blue appearance, clearly visible above the red background color of the gasoline. If only a qualitative detection of the marker in the gasoline is required, the developed, marked gasoline may be returned to the fuel source; thus avoiding a separate potentially hazardous waste disposal problem. If a quantitative determination of the marker is needed or desired, this can be accomplished by direct spectrophotometry, depending on the level of background interference from other components in the fuel. Otherwise, a 5 milliliter aliquot of a 10% solution of sodium chloride in distilled water may be added to the developed, marked fuel. When the mixture is shaken together for a short time the blue marker dianion will extract into a lower aqueous phase which may be separated and quantified as in Example 29.

EXAMPLE 33

100 milliliters of the gasoline solution containing 15 parts per million of Thymolphthalein has added to it 1 milliliter of a 10% solution of tetra n-butyl ammonium hydroxide in ethylene glycol mono n-propyl ether. The mixture almost immediately develops a blue color denoting the presence of the Thymolphthalein marker. An addition of 1 milliliter of iso stearic acid is now made which causes the blue color of the Thymolphthalein marker to disappear and restores the gasoline to its original appearance. The sample may then be returned to its original source.

EXAMPLE 34

50 milliliters of diesel fuel containing 5 parts per million each of Thymolphthalein and the di-n-butyl ester of Fluorescein as described in U.S. patent application Ser. No. 08/375,310, filed Jan. 20, 1995, (the disclosure of which is incorporated herein by reference) is placed in a clear glass 100 ml bottle and has added to it one milliliter of a 10% solution of tetra n-butyl ammonium hydroxide in ethylene glycol mono n-propyl ether. The mixture rapidly develops an appearance which is fluorescent blue by reflected light and fluorescent green by transmitted light, very distinct from the color of unmarked fuel. Part of the solution may be placed in a spectrophotometer cell and the relative intensities of the Fluorescein and Thymolphthalein dianions measured at their wavelengths of maximum absorbance which occur around 490 and 600 nanometers respectively. Alternatively the spectrophotometry may be carried out on an aqueous saline extract of the markers as described in Example 29. If this option is not pursued the developed, unextracted marked fuel may have added to it an aliquot of acid which neutralizes the marker dianions and restores the fuel to essentially its original appearance. It may then be returned to its original source.

EXAMPLES 35–42

By employing essentially similar synthesis reaction techniques to those illustrated in Examples 22 through 26, followed by the development technique of Example 29, the following further products were made and evaluated.

| Example | Acid Anhydride | Phenol | Visual Color | Dominant Wavelength of Absorption |
|---|---|---|---|---|
| 35 | Phthalic | 2 secbutyl phenol. | Bright Purple | 571.5 nm. |
| 36 | Phthalic | 2,6 di isopropyl phenol. | Bright Reddish Blue | 592.5 nm. |
| 37 | Phthalic | 2,6 disecbutyl phenol | Bright Royal Blue | 593.5 nm. |
| 38 | Phthalic | 2 tertiary butyl 5 methylphenol | Reddish Blue | 597 nm. |
| 39 | Phthalic | 2 n-propoxy phenol | Reddish Blue | 597 nm. |
| 40 | 2,3,4,5 tetrachloro Phthalic | 2 isopropyl 5 methyl phenol | Pure Blue | 621.5 nm. |
| 41 | Phthalic | 1 Naphthol | Turquoise Blue | 655 nm. |
| 42 | 2,3,4,5 tetrachloro phthalic | 1 naphthol | Neptune Blue | 658.5 nm. |

It should be noted that due to solvatotropism the above stated dominant wavelengths of absorption may change somewhat under different conditions of observation.

EXAMPLE 43

200 grams of a commercially available 40% solution of Benzyltrimethylammonium hydroxide in methanol was added to 900 grams of ethylene gylcol mono n-propyl ether (Glycol EP) contained in a stirred 2 liter reaction flask. The contents of the flask were evacuated to a pressure of 10 mm mercury and heated to 70° C. to remove all material volatile at this temperature and pressure. The contents of the flask were then reduced to ambient temperature and pressure and brought to 1000 grams by the addition of Glycol EP to replace the distilled methanol. The final composition was a 8% solution of Benzyltrimethylammonium hydroxide in Glycol EP to be used as a petroleum fuel marker developer.

EXAMPLE 44

The procedure of Example 43 was repeated except that the Benzyltrimethylammonium hydroxide was replaced by the corresponding methoxide salt.

EXAMPLE 45

1 ml of a 0.1% solution of Quinizarin (1,4 dihydroxy 9,10 anthraquinone) in Toluene was added to 100 mls of low sulfur, on road, diesel fuel. Quinizarin is a compound used to mark certain grades of fuel in the United Kingdom of Great Britain and Northern Ireland. The 10 ppm (parts per million) solution of the Quinizarin in the fuel, which had acquired a faint orange tint, had added to it a 1 ml aliquot of the developer solution prepared as example 1. The fuel immediately turned a strong, clear bluish violet color due to the conversion of the Quinizarin to its dianion. A portion of the solution was transferred to a 1 cm glass cell and scanned in a recording spectrophotometer. An absorbance of 0.46 units at a dominant wavelength of 569.5 nanometers was observed. The solution from the spectrophotometer cell was then added back to the bulk of purple marked diesel and to the recombined solution was added 1 ml of isostearic acid. The bluish violet color faded and the fuel returned to its original marked appearance. It was now suitable for return to its original source.

EXAMPLE 46

The procedure of Example 45 was repeated except that Quinizarin was replaced by an equal weight of its leuco derivative (2,3 dihydro 9,10 dihydroxy 1,4 anthraquinone) which contributes an almost imperceptible color to the marked fuel. This substance is also used as a petroleum fuel marker in Europe. The marker was then reacted with the developed solution of Benzyltrimethylammonium methoxide described as example 2. The developed marker was a reddish blue color with an absorbance of 0.295 units at a dominant wavelength of 574.5 nanometers.

EXAMPLE 47

100 mls of a 15 ppm. solution of 2 (2' ethylhexyl) Quinizarin, described as a fuel marker by Turner et al in U.S. Pat. No. 3,883,568, (the disclosure of which is incorporated herein by reference in its entirety) contained in low sulfur diesel fuel, had added to it a 1.0 ml aliquot of the marker developer described in Example 44. A reddish blue solution of the dianion was obtained immediately. Scanned in a spectrophotometric it had a dominant wavelength of 581.5 nanometers.

EXAMPLE 48

100 mls of a 10 ppm solution of Thymolphlthalein in water white gasoline has added to it 1 ml of a solution made by diluting 20 mils of a commercially available solution of tetramethylammonium hydroxide to 100 mls with 200 proof denatured ethanol. The gasoline turned bright blue and a spectrophotometric absorbance of 0.962 units at a wavelength of 609.5 nanometers in a 1 cm glass cell was observed. Addition to the developed fuel of 1 ml of a 50% (by weight) solution of 2 Ethylhexoic acid in denatured alcohol returned the marked gasoline to its original water white appearance.

EXAMPLE 49

A sample of a proposed marker substance Phenol, 2,6-bis(1 methylpropyl)4[(4 nitrophenyl)azo] synthesized by the method of Example 1 of Friswell et al in U.S. Pat. No. 5,156,653 was prepared as 100 ml of a 10 ppm (active material) solution in water white gasoline, which assumed a pale straw color. To this solution was added 1 ml of the ethanolic solution of tetramethylammonium hydroxide described in Example 43 of this application. A dark reddish blue color developed instantly. The intensity of the spectrophotometric absorbance at a dominant wavelength of 577.5 nanometers was slightly less than one half of that observed for the Thymolphthalein exampled in Example 48 of this application. Addition of a small amount of 2-ethylhexoic acid to the developed fuel restored it to its pale straw yellow color and a condition suitable to return to an original fuel source. Unlike the procedure described in Example 15 of U.S. Pat. No. 5,156,553, no separate extraction procedure is required to detect the marker substance. Nor is it necessary to provide for the separate disposal of a potentially hazardous aqueous marker extract and the water wet fuel. By use of the present marker development procedure, the gasoline of this Example remains essentially anhydrous, or at least without the physical separation of any water. Furthermore, detection of the marker is essentially instant by the present procedure which makes it much more convenient to use for instance in roadside tests by enforcement officers.

EXAMPLE 50

100 ml of marked gasoline prepared as in Example 49 is placed in a 250 ml separatory funnel. To this is added 20 mls of a mixture composed (by volume) of 10 parts tetramethylammonium hydroxide 40% aqueous solution, 40 parts water, 50 parts Glycol EP. The fuel and developer composition is shaken together and develops a strong blue color, it is then allowed to settle. The marker extracts in the lower aqueous phase and may be quantified for instance by the method detailed in example 15 of U.S. Pat. No. 5,156,653. The tetramethylammonium hydroxide developer composition that we propose as a developer has much less objectionable odor than the aliphatic primary amine composition prescribed in the above patent-specification.

EXAMPLE 51

100 mls of 10 ppm solution in water white gasoline of 2,4,5,7 tetrabromo 3,6 diacetoxy fluoresceine, prepared as described in U.S. patent application Ser. No. 08/375,310, filed Jan. 20, 1995, (the disclosure of which is incorporated herein by reference) has added to it 1 ml of the developer reagent prepared as in Example 43. It develops a clear bright distinctive fluorescent peach-pink color which has a dominant wavelength of absorption at 533 nanometers. The developed marker color may be bleached by the addition of a small amount of isostearic acid.

EXAMPLE 52

A sample of 1(3H)-Isobenzofuranone,3,3-bis(4-hydroxy-1-naphthyl) prepared as Example 41 is prepared as a 20 ppm. solution in a strongly, naturally yellow colored, specimen of high sulfur content #2 home heating oil. A portion is reserved to put in a spectrophotometer reference cell. To 50 ml of the same solution is added 0.5 ml of the developer reagent described in Example 43. The fuel turns an olive green color, a spectrophotometric scan reveals a relatively sharp absorption peak at 660 nanometers at which wavelength there is minimal interference from the original background color of the fuel. The addition of 1.0 ml of technical oleic acid to the developed fuel restores it to its original appearance.

Applicant's invention has been described with reference to preferred embodiments. Numerous modifications to the described invention may be made without departing from the scope of the invention.

What is claimed is:

1. A method of identifying a petroleum product containing a base reactable marker comprising:

a) obtaining a sample of petroleum product containing a base reactable marker;

b) adding to said sample a developing agent comprising a quaternary alkyl ammonium base of the following formula:

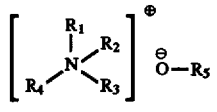

wherein $R_1$, $R_2$, $R_3$ and $R_4$ are the same or different alkyl or benzyl groups and $R_5$ is hydrogen or an alkyl group.

2. A method as recited in claim 1 wherein said developing agent is a non-aqueous solution containing about 1% to about 10% of said quaternary alkyl ammonium base and a solvent miscible with said petroleum product.

3. A method as recited in claim 2 wherein said solvent is selected from the group consisting of methanol, ethanol, propanol, aromatic alcohols, glycols and glycol ethers.

4. A method as recited in claim 3 wherein said alkyl glycol ether is ethylene glycol mono n-propyl ether.

5. A method as recited in claim 1 further comprising the step of adding to said sample, after color or fluorescence has been developed, an acid miscible with said petroleum product to eliminate the developed color or fluorescence.

6. A method as recited in claim 5 wherein said acid is selected from the group consisting of organic carboxylic acids.

7. A method as recited in claim 2 wherein said developing agent is selected from the group consisting of:

tetraethylammonium hydroxide tetrapropylammonium hydroxide tetra n-butyl ammonium hydroxide Benzyltrimethylammonium hydroxide Benzyltrimethylammonium methoxide.

8. A method as recited in claim 3 comprising a 8% solution of Benzyltrimethylammonium hydroxide in ethylene glycol mono n-propyl ether.

9. A marker as recited in claim 1 and further comprising about 50% to about 95% solvent and about 5%–50% marker to provide a non-aqueous marker solution.

10. A marker as recited in claim 13 wherein said solvent is comprised of about 40% aprotic solvent and about 60% aromatic solvent, said aromatic solvent being miscible in said petroleum product.

11. A method of identifying a petroleum product containing a base reactable marker, without subsequent extraction, comprising:

a) obtaining a sample of petroleum product containing a base reactable marker;

b) adding to said sample a developing agent comprising a quaternary alkyl ammonium base of the following formula:

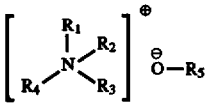

wherein $R_1$, $R_2$, $R_3$ and $R_4$ are the same or different alkyl or benzyl groups and $R_5$ is hydrogen or an alkyl group.

12. A method as recited in claim 11 wherein said developing agent is a non-aqueous solution containing about 1% to about 10% of said quaternary alkyl ammonium base and a solvent miscible with said petroleum product.

13. A method as recited in claim 12 wherein said solvent is selected from the group consisting of methanol, ethanol, propanol, aromatic alcohols, glycols and glycol ethers.

14. A method as recited in claim 10 wherein said alkyl glycol ether is ethylene glycol mono n-propyl ether.

15. A method as recited in claim 11 further comprising the step of adding to said sample, after color or fluorescence has been developed, an acid miscible with said petroleum product to eliminate the developed color or fluorescence.

16. A method as recited in claim 12 wherein said acid is selected from the group consisting of organic carboxylic acids.

17. A method as recited in claim 9 wherein said developing agent is selected from the group consisting of:

tetraethylammonium hydroxide tetrapropylammonium hydroxide tetra n-butyl ammonium hydroxide Benzyltrimethylammonium hydroxide Benzyltrimethylammonium methoxide.

18. A method as recited in claim 10 comprising a 8% solution of Benzyltrimethylammonium hydroxide in ethylene glycol mono n-propyl ether.

19. A marker for petroleum products comprising at least one compound selected from the group consisting of:

I.

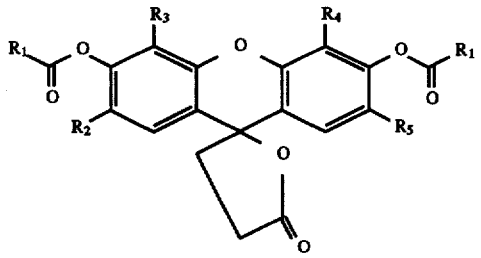

and

II.

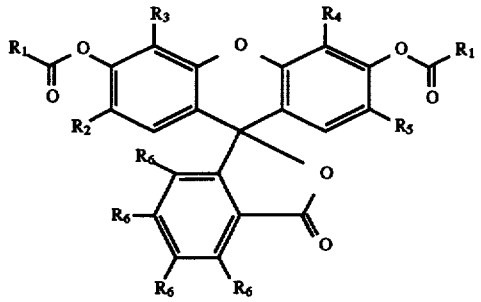

wherein $R_1$ is an alkyl of 1–18 carbon atoms or an aryl group; $R_2$, $R_3$, $R_4$ and $R_5$ are hydrogen, chlorine, bromine or $C_1$–$C_{12}$ alkyl and $R_6$ is hydrogen, chlorine or bromine. said $R_1$–$R_6$ may be the same or different groups and alkyl groups may be straight chain or branched chain;

with at least one compound selected from the group consisting of:

III.

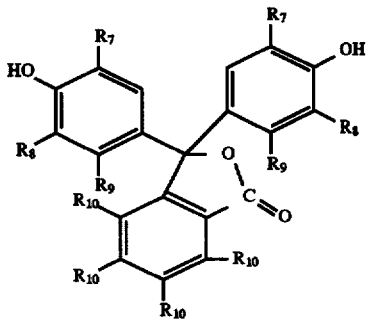

and

-continued

IV.

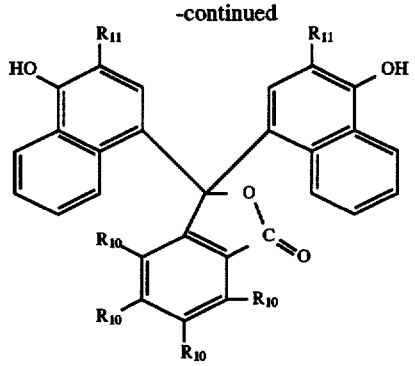

wherein $R_7$ is an alkyl or alkoxy group containing 1 to 8 carbon atoms; $R_8$ and $R_9$ are hydrogen, alkyl or alkoxy groups; $R_{10}$ is any combination of bromine, chlorine, or hydrogen and $R_{11}$ is hydrogen, an alkyl or an alkoxy group containing $C_1$–$C_8$.

20. A marker as recited in claim 19 wherein $R_1$ is selected from the group consisting of $C_1$–$C_4$.

21. A marker as recited in claim 19 wherein $R_2$–$R_6$ are hydrogen.

22. A marker as recited in claim 19 wherein $R_7$ is $C_3H_7$, $R_8$ is hydrogen, $R_9$ is $CH_3$, and $R_{10}$ is hydrogen.

23. A marker as recited in claim 19 wherein the total number of alkyl carbon atoms in $R_7$, $R_8$, and $R_9$ combined does not exceed 12.

24. A marker as recited in claim 19 further comprising a solvent wherein the marker is in liquid form.

25. A fluid marker as recited in claim 24 wherein said solvent is selected from the group consisting of aromatic hydrocarbons, aromatic alcohols and aprotic solvents.

26. A fluid marker as recited in claim 25 wherein said fluid marker comprises, by weight, about 5–50% marker and about 50–95% solvent.

27. A fluid marker as recited in claim 26 wherein said fluid marker comprises, by weight, about 15–25% marker and about 75–85% solvent.

28. A fluid marker as recited in claim 26 wherein said fluid marker comprises, by weight, about 5–10% marker; about 70–80% aromatic solvents, and about 10–30% aprotic solvents.

29. A fluid marker as recited in claim 28 wherein said aprotic solvent is selected from the group consisting of formamide, 1 methylpyrrolidone, N,N dimethylformamide and N,N dimethylacetamide.

* * * * *